US006770001B1

(12) United States Patent
Shoemaker, Jr.

(10) Patent No.: US 6,770,001 B1
(45) Date of Patent: Aug. 3, 2004

(54) VACUUM CRANE GAME WITH BEADED TARGETS

(76) Inventor: Stephen P. Shoemaker, Jr., 531 N. Fransisca Ave., Redondo Beach, CA (US) 90277

( * ) Notice: Subject to any disclaimer, the term of this patent is extended or adjusted under 35 U.S.C. 154(b) by 0 days.

(21) Appl. No.: 10/639,730

(22) Filed: Aug. 12, 2003

(51) Int. Cl.[7] ..... A63B 7/36
(52) U.S. Cl. ..... 473/447; 273/448
(58) Field of Search ..... 273/440, 447, 273/448

(56) References Cited

U.S. PATENT DOCUMENTS 5,513,772 A 5/1996 Glaser
5,855,374 A 1/1999 Shoemaker, Jr.
6,598,881 B1 * 7/2003 Shoemaker, Jr. ..... 273/447
2003/0151202 A1 * 8/2003 Fisher et al. ..... 273/447

* cited by examiner

*Primary Examiner*—Raleigh W. Chiu
(74) *Attorney, Agent, or Firm*—Fulwider Patton Lee & Utecht, LLP

(57) ABSTRACT

A crane game with a vacuum head adapted to pick up objects with a smooth extraction surface is disclosed wherein the objects, or targets, include perturbations such as bead shaped projections or dimples that present a more challenging target by reducing the available extraction surface. Disk shaped, spherical, or other shaped targets include one or more perturbations that may prevent a seal from being formed with the suction head, denying extraction of the target by the vacuum head. Values may be assigned to the targets based on the number of perturbations, or the targets may encapsulate prizes of a value directly related to the available extraction surface on the target.

33 Claims, 5 Drawing Sheets

VACUUM CRANE GAME WITH BEADED TARGETS

BACKGROUND OF THE INVENTION

1. Field of the Invention

The present invention relates to amusement devices known as vacuum crane games, and more particularly to a vacuum crane game with targets having beaded or dimpled surfaces such that the targets can be presented with varying difficulty in their acquisition and extraction.

2. Description of Related Art

Crane-type or "claw machine" arcade games are popular amusement devices often provided in game arcades, stores, or other public places. In these types of games, prize objects are provided within a closed housing and are viewable by a player through transparent glass or the like. Upon the insertion of a coin or other monetary input into the game, the player controls a mechanical claw or other grasping implement with a joystick, buttons, toggle switch, or the like. Typically, the claw is provided above the prize objects and the player can change the position of the claw over the prizes. The claw is then lowered toward the prizes upon activation by either automatically by a controller such as a computer or manually by the player, depending on the particular embodiment. The claw is either automatically opened when it reaches the level of the prizes or is opened under the player's control. After a predetermined amount of time, the claw may be automatically elevated. The claw may or may not be able to grasp a prize and hold onto the prize as the claw is raised. The controller then moves the claw over to a dispensing container and opens the claw, allowing the prize (if any is held) to drop into the dispensing chute and to be guided through the dispenser to an opening accessible to the player. In a common implementation, a sensor within the dispenser detects whether a prize has been won by the player. After the claw is opened over the dispenser, the controller moves the claw to its original starting position and waits for another insertion of the coin (unless the player is provided with multiple tries).

The prizes that the operator of a claw-type crane game can provide in the game are usually limited in selection due to the limitations of the mechanical claw. Since the claw must surround an object to be able to pick it up, most prizes in a claw-type crane game have been limited to large stuffed dolls or other soft, rough-surfaced merchandise that can be surrounded and grabbed by the claw fingers and raised from the supporting surface. Usually, flat, smooth or thin objects are not able to be picked up and held by the claw. However, a large number of flat, smooth, and thin objects are desirable to used as prizes in a crane-type game, such as smooth-surfaced spheres or eggshell containers, boxes, gumballs, cups, bulbs, trading cards, etc. Players desire to win these types of items and operators desire to provide them; however, the standard claw type mechanism cannot be used to pick them up.

One solution to the inability of claw-type cranes to pick up these objects is to provide a different type of pick-up device. One type of device that is used is a vacuum device that uses air suction to grab and hold an object. In U.S. Pat. No. 5,513,772 of Glaser, a vacuum embodiment of a crane pick-up game is disclosed in which a vacuum motor is suspended from a string and concealed by a facade or enclosure. The player may move the motor and lower the motor towards a field of prizes similarly to the claw in claw-type crane games. A spinning fan within the motor creates a suction force that is used to pick up and hold prizes. An orifice with a screen is used to prevent items from being sucked into the orifice. Prizes captured and held by the suction are dispensed to the player through a dispenser.

More recent vacuum crane games have improved on the concept and made the game more challenging. In my U.S. Pat. No. 5,855,374, a vacuum crane game is disclosed wherein the vacuum head is used to pick up one of the prizes using a suction force that is provided by a vacuum pump coupled to the vacuum head by a hose and located away from the vacuum head. Moving the pumping apparatus away from the crane head mechanism provides greater maneuverability than previous devices that carried the pumping equipment at the crane head. In general, the vacuum crane game is characterized by a vacuum pick up device positioned above the prize or target area and may be moved along a horizontal axis above the prize area. The pick up device includes a vacuum head that may be raised and lowered toward a turntable in a z-direction. The vacuum head is operative to pick up one of the prizes using a suction force that is provided by a vacuum pump coupled to the vacuum head by a hose. The vacuum pump is located away from the vacuum head to allow the vacuum head to move without interference. The player may control the movement of the pick up device to position the vacuum head over the prize area at a desired position, lower the vacuum head, and pick up a prize using the suction force. The pick up device is moved to a dispenser area and the suction force is removed to allow the prize to be dispensed to the player. The disclosure of my '374 patent is incorporated fully herein by reference. In another embodiment, the vacuum head may be moved in both x- and y-directions above the prize area and the turntable is omitted.

With vacuum crane games, it is desirable to provide prizes having smooth continuous surfaces such that a seal can be formed by the vacuum head against the prize. Without a complete seal, the vacuum head cannot effectively apply suction to the prize sufficiently to enable the prize to be lifted out of the prize bin. As a consequence, prizes such as jewelry, trading cards, candy, and toys are typically enclosed in transparent or opaque spheroids such as spheres and egg-shaped plastic containers. Such spheroids will have exteriors that meet the requirement of smooth, continuous surfaces allowing the vacuum head to make complete, sealing contact. An example of this type of prize collection for a vacuum crane game can be found in my U.S. Pat. No. 6,598,881, entitled "Crane Game with Prize Redistribution Mechanism" and incorporated herein fully by reference.

While the collection of spheroids in the prize bin of a vacuum crane game provides an enjoyable alternative to mechanical crane games that are used to pick-up irregularly shaped prizes, the challenge of picking up a spheroid once mastered may wane for the player seeking greater challenges. As a consequence, skilled players seeking a challenging game may look to other options due to the absence of variety of the spheroid targets. Further, the options of prizes may be limited to those objects that can fit inside a relatively small spheroids since larger spheroids would take up too much space in the prize bin.

SUMMARY OF THE INVENTION

The present invention is characterized in a first preferred embodiment by a vacuum crane game with targets having substantially smooth surfaces interrupted strategically with beaded nodules or bumps of varying number and positions to present prizes of varying capture difficultly. Because the flat vacuum crane head requires uninterrupted contact with the target to achieve an airtight seal, the crane game player must either avoid or completely cover the surface bumps to pick up a target. If the vacuum head rests on one or more of the beaded nodules, no seal can be achieved and the capture of the target will be unsuccessful. Targets with more bumps will be inherently more difficult to pick up than targets with fewer nodules, and with a variety of different targets having different bump configurations the game has challenges for all skill levels.

In a first embodiment, the target bin of a vacuum crane game is supplied with a plurality of transparent disks resembling Petri dishes having front and rear faces, and where the respective faces include beads ranging from zero to ten or more spaced along the surface. Inside the transparent disks are cards or tags that can be easily viewed by the player showing a prize reward for successfully retrieving the target from the prize bin. A reward can be a numerical point value displayed on the tag that can be applied to redeem prizes, or alternatively the tag can specify a prize displayed at some location where the target is redeemed. In yet a third embodiment, the prize can be physically located inside the disk. The value of the reward is tied to the number and location of the beads, where higher number of beads or centrally located beads correspond to a higher degree of difficulty due to a smaller available continuous surface, and such targets possess a higher prize redemption value.

Alternative target shapes can be used in place of transparent disks, such as flat chips with numerical values printed thereon, transparent capsules or spheres with tags viewable from the outside, or boxes, where each target includes substantially flat surfaces with beads on the surfaces to add difficulty to the task of retrieving the target. Alternatively, the beads can be replaced with dimples that likewise act to breakup the continuous surface and increase the difficulty of making an uninterrupted contact with the vacuum crane head. In yet another alternate embodiment, grooves in the surface of the target can resist the application of suction because the air is drawn in at the ends of the grooves, preventing adherence of the target with the vacuum head. Each of these devices can be used to create a more difficult target for a vacuum crane game.

DETAILED DESCRIPTION OF THE PREFERRED EMBODIMENTS

Figure 1:
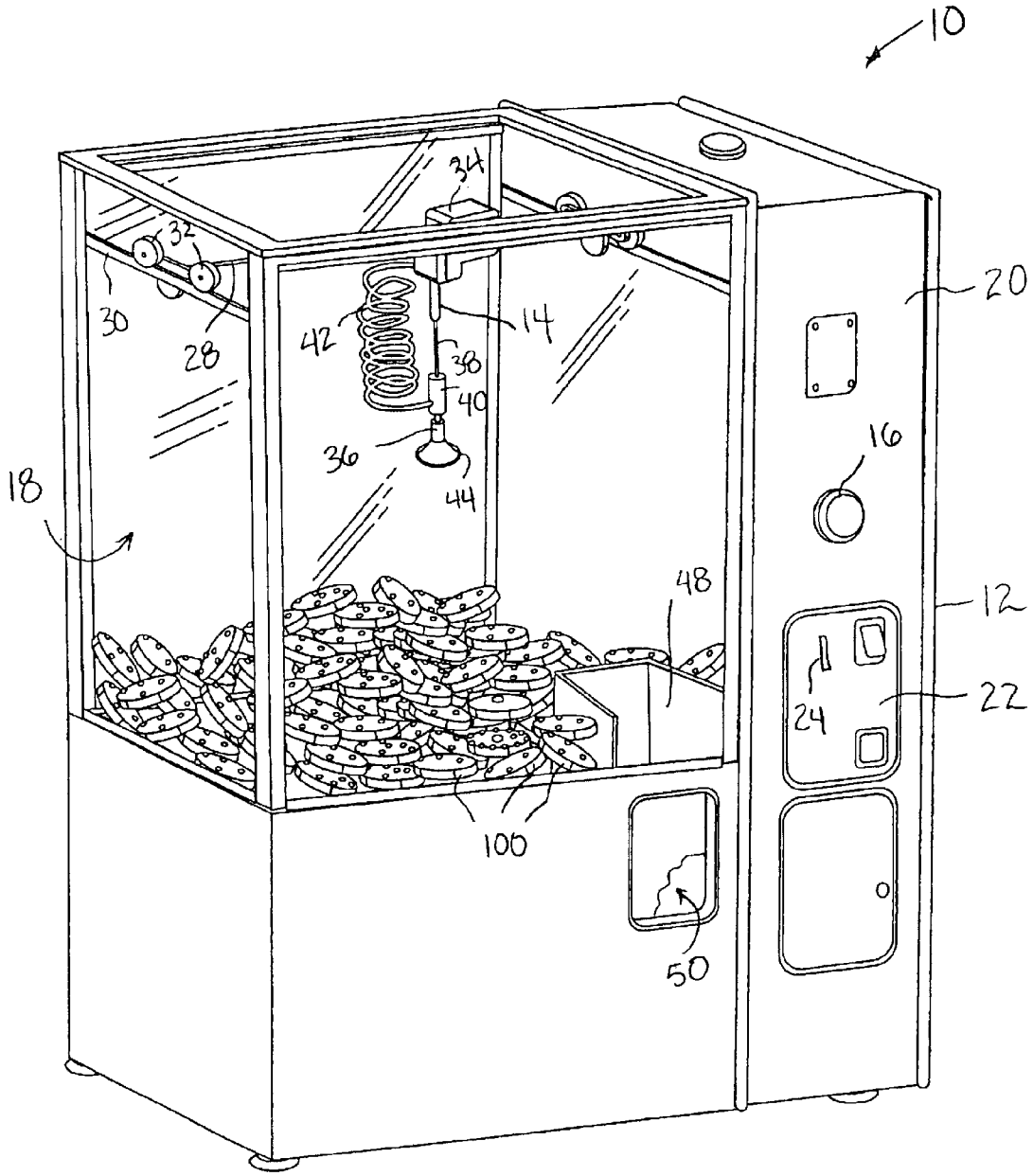
FIG. 1 is a perspective view of a vacuum crane game and target bin housing targets with beaded surfaces.

FIG. 1 is a perspective view of one embodiment of a game apparatus 10 in accordance with the present invention. Game apparatus 10 includes a housing 12, vacuum crane 14, player controls 16, and a target bin 18. The construction and operation of a vacuum crane game is known to one of ordinary skill in the art, and extensive discussion of the construction and operation of the vacuum crane game is omitted in favor of a brief overview for the sake of brevity.

A crane game 10 includes a housing 12 divided into two sections, a target bin 18 on a first half of the housing and a storage compartment 20 on the other half of the housing. The storage compartment 20 can enclose pumping equipment and the electronics to manipulate the vacuum crane 14 and produce any sounds or visual effects that accompany the game play. The storage compartment 20 can also provide a repository for surplus prizes or targets as the inventory in the target bin 18 is depleted. On the housing 12 is a control panel 22 including a slot 24 for receiving the tokens, coins, money, or game cards that initiates a game play. The control panel 22 further includes a controlling device such as a joystick or button 16, or the like for maneuvering the crane 14 within the target bin 18. The target bin 18 includes a boom 28 spanning its width and driven along two horizontal rails 30 on a set of rollers 32. Using the controlling device 16 to actuate an electrical motor, the boom 28 can be positioned along the path between the front and rear walls of the target bin.

In addition to controlling the position of the boom in the forward/rearward direction, a carriage assembly 34 rides on the boom 28 and translates across the boom 28 from the left side to the right side of the target bin 18. Once again, the controlling device 16 initiates movement of the carriage assembly 34 along the boom 28 such that, by manipulating the controlling device in a particular manner the carriage assembly 34 can be positioned substantially over any object in the target bin 18. The carriage assembly 34 is driven by an electric motor or other device that is controlled by the button 16 or other similar input device.

The crane assembly 14 includes a vacuum head 36 suspended as a crane by a retractable cable 38 and weight assembly 40, and further connected to a coiled suction line 42 leading to a pump (not shown), wherein suction from the pump is communicated through the suction line 42 to the distal end of the vacuum head 36. The head 36 includes a circular lip 44 or peripheral edge selected to mate with the respective extraction surfaces of the targets 100 in the target bin 18 to form a substantially air-tight seal. When the vacuum head 36 is engaged with a target 100 in a sealing relationship (see FIG. 3) and suction is communicated to the vacuum head 36, the negative pressure inside the vacuum head will cause the target 100 to adhere to the peripheral lip 44 and be captured. As long as suction is maintained at the vacuum head 36 and the seal between the target 100 and the peripheral lip 44 is maintained, the captured target will remain held connected.

The vacuum crane game 10 may include a sensing mechanism (not shown) that determines when a target 100 has been captured by the vacuum head 36, and initiates an operation whereby the vacuum head 36 is raised above the collection of targets 100 and directed to an extraction chute 48 separated from the targets 100. The suction is automatically disconnected when the vacuum head 36 resides over the extraction chute 48, causing the captured target to fall into the extraction chute where it enters a compartment 50 that can be accessed by the player. The challenge for the skilled player is to identify a target 100 first and then using the controlling device 16 maneuver the vacuum head 36 appropriately until the peripheral lip 44 of the vacuum head 36 is directly above the selected target, and then the vacuum head is lowered onto the target 100 until mating results in capture and finally extraction.

Figure 2A:
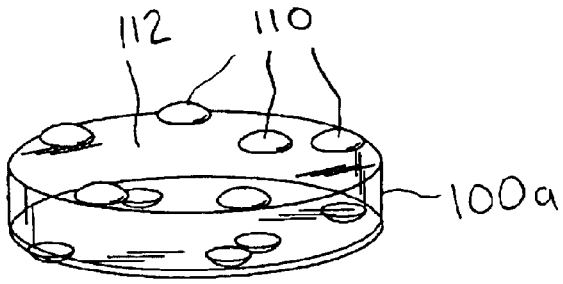
FIG. 2*a* is a first preferred embodiment of a target of the vacuum crane game of FIG. 1.
Figure 2B:
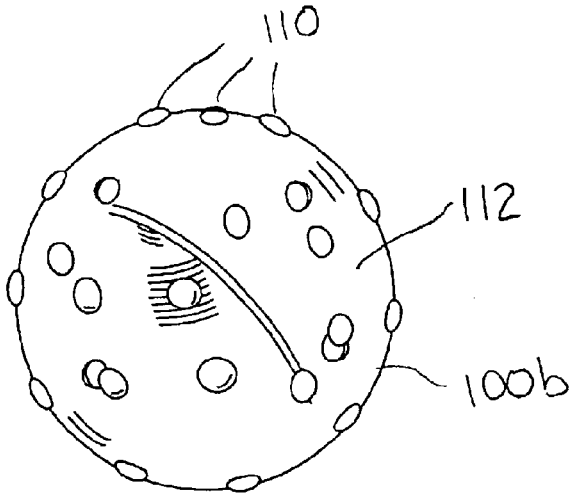
FIG. 2*b* is a second preferred embodiment of a target of the vacuum crane game of FIG. 1.
Figure 2C:
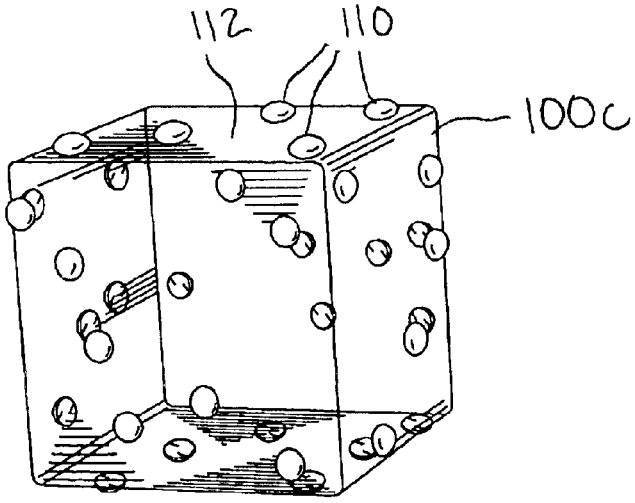
FIG. 2*c* is a third preferred embodiment of a target of the vacuum crane game of FIG. 1.

As shown in FIG. 2, in the present invention the targets 100 present additional challenges in that the target's original extraction surfaces are reduced by the presence of perturbations 110 such as bead shaped projections. The bead shaped projections or bumps increase the difficulty because the vacuum head 36 will be unable to achieve a seal against the target 100 if the vacuum head 36 is located such that the peripheral lip 44 contacts the bead shaped projection (see FIG. 4). Thus, the target 100 will not be captured by the vacuum head 36 in this case. The player must therefore avoid the projections 110 as he attempts to land the vacuum head 36 on the target's available extraction surface 112 (the uninterrupted smooth surface between or around the projections). Adding additional perturbations 110 further reduce the available extraction surface 112 and increase the difficulty, as will the strategic locating of the perturbations 110 to break-up the largest extraction surface areas.

The targets themselves can take the shape of disks 100*a* approximating the size of a Petri dish and defining two extraction surfaces 112, namely the flat smooth top and bottom faces of the disk. Perturbations 110 such as bead shaped projections can be formed on the faces during the manufacturing process or added later. The present inventor has found that using a hot glue gun, beads can be quickly and easily created on the target's surface that, once dried and hardened, will suffice to effectively reduce the available extraction surface 112 of the disk shaped targets 100*a*. This procedure can also be applied to spherical targets 100*b* as well, such as a plastic two-piece capsules with interlocking halves or egg-shaped containers that can be used to hold prizes therein. Other shaped targets 100*c* are also possible.

Figure 7:
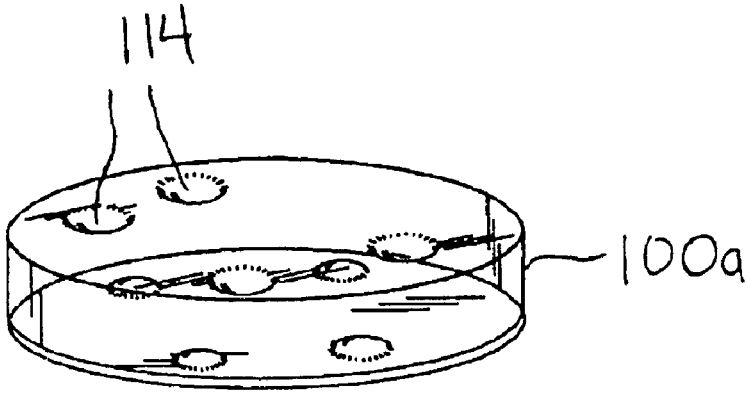
FIG. 7 is an elevated perspective view of a target with dimples.

Alternatively, the perturbation can be a recess such as a dimple 114 (see FIG. 7), slot, or cavity, or set of grooves in the surface that will similarly reduce the available extraction surface. In each case, the perturbation prevents the vacuum head 36 from sealing with the targets smooth, continuous surface and thus extraction is resisted. The shape of the perturbation 110 is limited only to departures in the curvature or continuity of the extraction surface for the purpose of resisting capture of the target, although bead or bubble shaped perturbations are found to work well with the present invention.

As shown in FIGS. 6A–G, the number and placement of the perturbations can result in a varying scale of difficulty assigned to the various targets, with a higher difficulty assigned to targets with five or more perturbations and lower difficulty assigned to four or fewer. Furthermore, spacing can also affect the assigned difficulty level of the target. The difficulty level can then be used to determine the appropriate reward for successfully capturing and extracting the various targets. For example, a system where the targets represent redemption values that can be tracked by inserting tags with point values in each target is benefited by the present invention. Each target is assigned a value of points that can be redeemed for prizes or other rewards, and the player is challenged to attempt to retrieve the most difficult targets and reap the greatest rewards or try the easier targets and accumulate points more slowly. The system provides much greater interest and intrigue to the amusement device.

Figure 3:
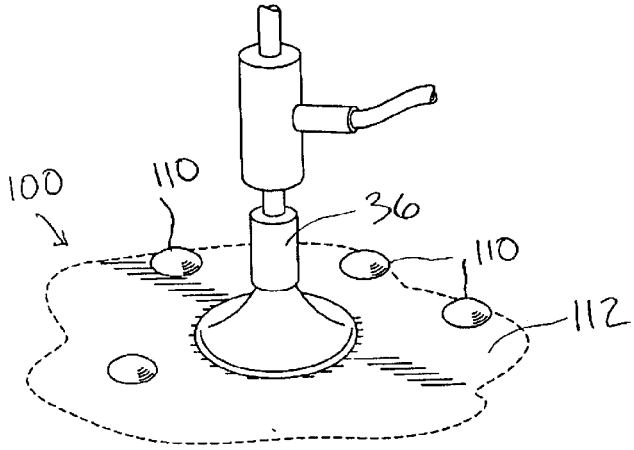
FIG. 3 is an elevated perspective view of a vacuum head of the vacuum crane game of FIG. 1 attempting to lift a target.
Figure 4:
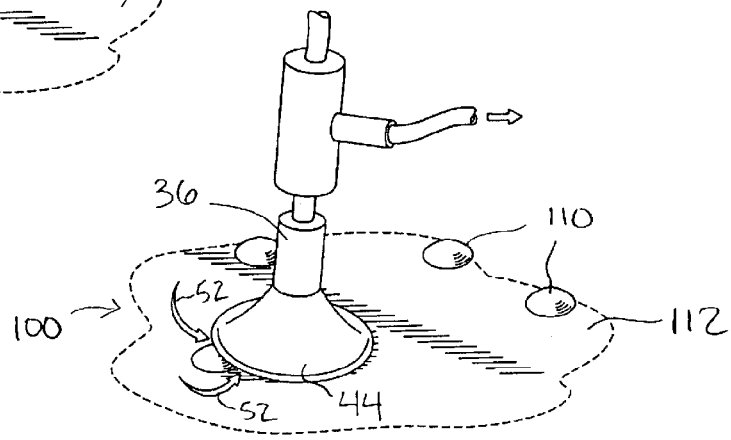
FIG. 4 is an elevated perspective view of a vacuum head of the vacuum crane game of FIG. 1 in which the head's periphery lies on a target perturbation.
Figure 5:
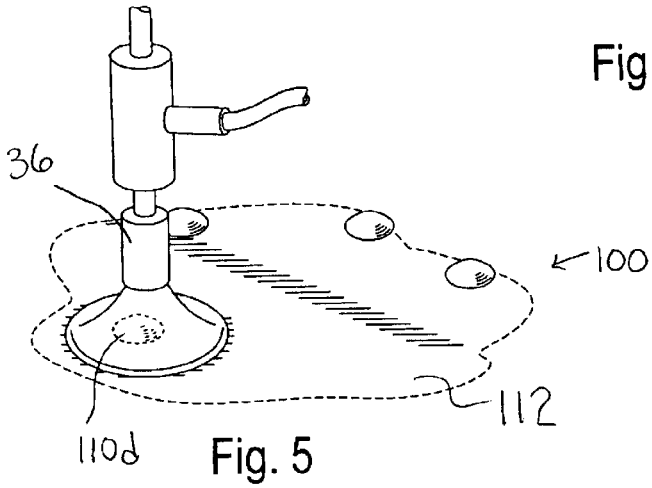
FIG. 5 is an elevated perspective view of a vacuum head of the vacuum crane game of FIG. 1 in which the head's periphery lies over a target perturbation.
Figure 6A:
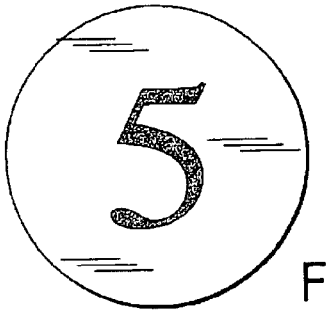
FIGS. 6A–G are top views of variations of the target of FIG. 2*a* with multiple perturbations and point values.
Figure 6B:
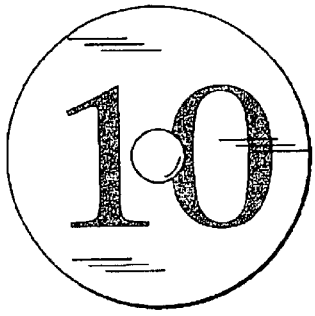
Figure 6C:
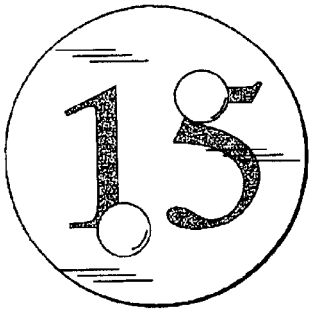
Figure 6D:
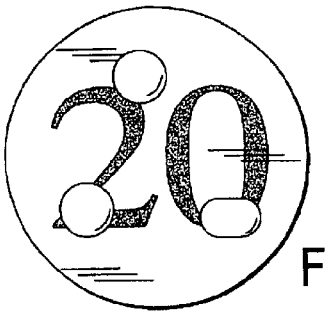
Figure 6E:
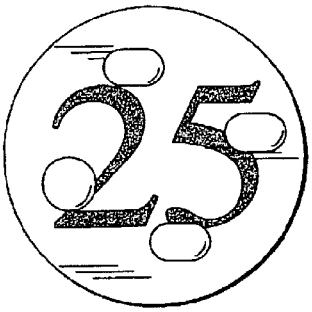
Figure 6F:
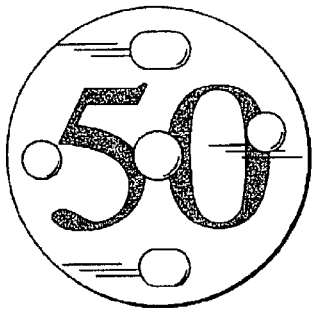
Figure 6G:
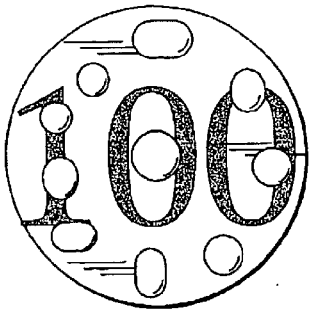

As shown in FIGS. 3–5, when the vacuum head 36 comes into contact with the extraction surface 112 of the target 100 of the present invention, three possibilities are present. First, the player can maneuver the vacuum head 36 clear of the perturbations 110 and create a sealing relation with the extraction surface 112, enabling the target 100 to be captured and extracted (FIG. 3). Second, the vacuum head 36 can contact the extraction surface 112 such that the peripheral lip 44 of the vacuum head 36 resides on top of the perturbation i.e., the perturbation is partially but not totally covered by the vacuum head 36 (FIG. 4). In this case, the suction at the vacuum head 36 is defeated by the gap between the extraction surface 112 and the peripheral lip 44, as air represented by arrows 52 flows through the gap preventing adherence of the target 100 to the vacuum head 36. This prevents the target 100 from being captured and extracted. Finally, the vacuum head 36 in the third case (FIG. 5) can rest completely over the perturbation 100*d* and form a seal on the extraction surface 112 around the perturbation 100*d*, allowing capture and extraction of the target 100. As more perturbations 110 are added to a target, the available extraction surface 112 is reduced and the difficulty in maneuvering the vacuum head 36 to a suitable position for capture is increased.

Figure 8:
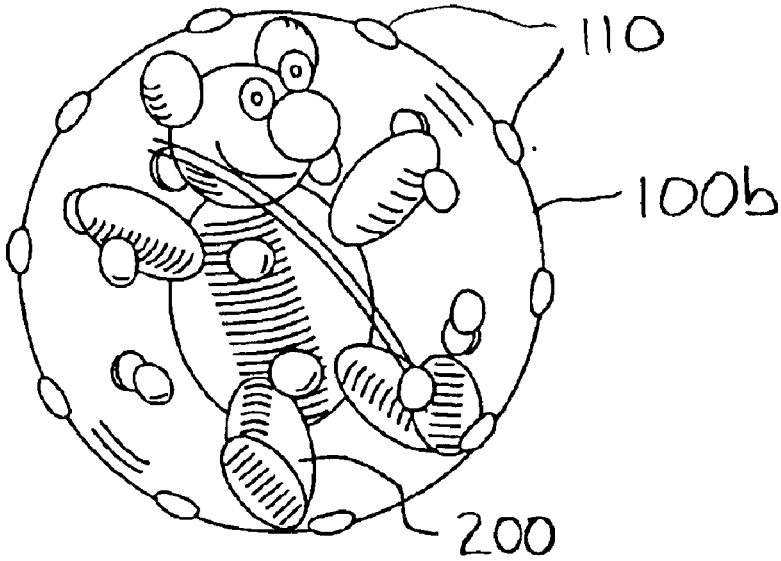
FIG. 8 is an elevated perspective view of an alternative target with a prize inside.

As described above, the present invention increases the difficulty level of a crane game target 100 by introducing areas where suction against the surface of the target is rendered more difficult. The term "target" is used in the disclosure because the object to be picked up may be a prize, or it may be a holder for a marker or ticket reflecting a point value. Extraction of the holder allows the player to accumulate these markers for redemption at a designated location. The holders themselves can be disk shaped, spheres, boxes, or other suitable container having substantially smooth surfaces capable of achieving a seal with the vacuum head. The vacuum head 36 is typically conical with a circular base that allows round objects to be captured as well as objects with flat surfaces such as boxes or flat chips. The holders may also house a prize 200 itself, as shown in FIG. 8.

What is claimed is:

1. A vacuum crane amusement apparatus having a target bin for housing a plurality of targets, a vacuum head including a peripheral lip at a first end for engaging a target in a sealing relationship, a pump for introducing suction at the peripheral lip to capture a sealingly engaged target, a control for maneuvering the vacuum head within the target bin, and an extraction chute for removing captured targets from the target bin, the apparatus further comprising:

a plurality of targets in the target bin having an extraction surface characterized by a smooth contour engageable with the peripheral lip of the vacuum head in a sealing relationship, the extraction surface further characterized by at least one perturbation interrupting said smooth contour such that said perturbation thwarts capture of the target by the vacuum head if disposed between the peripheral lip of the vacuum head and the extraction surface by preventing a sealing engagement therebetween.

2. The amusement device of claim 1 wherein the targets are disk shaped, and each disk shaped target has first and second extraction surfaces on opposite faces.

3. The amusement device of claim 2 wherein the perturbation on the target is a bead shaped projection.

4. The amusement device of claim 3 wherein the targets differ in quantity of bead shaped projections.

5. The amusement device of claim 4 wherein the targets are assigned a redemption value corresponding to the quantity of bead shaped projections.

6. The amusement device of claim 4 wherein the targets include a cavity disposed between the first and second extraction surfaces, the cavity encapsulating a prize.

7. The amusement device of claim 6 wherein the value of the prize corresponds to the quantity of bead shaped projections.

8. The amusement device of claim 2 wherein the perturbation on the target is a dimple.

9. The amusement device of claim 8 wherein the targets differ in quantity of dimples.

10. The amusement device of claim 9 wherein the targets are assigned a redemption value corresponding to the quantity of dimples.

11. The amusement device of claim 9 wherein the targets include a cavity disposed between the first and second extraction surfaces, the cavity encapsulating a prize.

12. The amusement device of claim 11 wherein the value of the prize corresponds to the quantity of dimples.

13. The amusement device of claim 1 wherein the targets are spherical.

14. The amusement device of claim 13 wherein the perturbation on the target is a bead shaped projection.

15. The amusement device of claim 14 wherein the targets differ in quantity of bead shaped projections.

16. The amusement device of claim 15 wherein the targets are assigned a redemption value corresponding to the quantity of bead shaped projections.

17. The amusement device of claim 15 wherein the spherical targets include a cavity encapsulating a prize.

18. The amusement device of claim 17 wherein the value of the prize corresponds to the quantity of bead shaped projections.

19. The amusement device of claim 13 wherein the perturbation on the target is a dimple.

20. The amusement device of claim 19 wherein the targets differ in quantity of dimples.

21. The amusement device of claim 20 wherein the targets are assigned a redemption value corresponding to the quantity of dimples.

22. The amusement device of claim 20 wherein the spherical targets include a cavity encapsulating a prize.

23. The amusement device of claim 22 wherein the value of the prize corresponds to the quantity of dimples.

24. The amusement device of claim 1 wherein the perturbation on the target is a bead shaped projection.

25. The amusement device of claim 24 wherein the targets differ in quantity of bead shaped projections.

26. The amusement device of claim 25 wherein the targets are assigned a redemption value corresponding to the quantity of bead shaped projections.

27. The amusement device of claim 25 wherein the spherical targets include a cavity encapsulating a prize.

28. The amusement device of claim 27 wherein the value of the prize corresponds to the quantity of bead shaped projections.

29. The amusement device of claim 1 wherein the perturbation on the target is a dimple.

30. The amusement device of claim 29 wherein the targets differ in quantity of dimples.

31. The amusement device of claim 30 wherein the targets are assigned a redemption value corresponding to the quantity of dimples.

32. The amusement device of claim 30 wherein the spherical targets include a cavity encapsulating a prize.

33. The amusement device of claim 32 wherein the value of the prize corresponds to the quantity of dimples.

* * * * *